US007296584B2

(12) United States Patent
Goldwitz

(10) Patent No.: US 7,296,584 B2
(45) Date of Patent: Nov. 20, 2007

(54) SYSTEM AND METHOD FOR STORING, ASSEMBLING AND TRANSPORTING A CANOPY

(75) Inventor: Brian Goldwitz, Orange, CT (US)

(73) Assignee: ShelterLogic LLC, Watertown, CT (US)

( * ) Notice: Subject to any disclaimer, the term of this patent is extended or adjusted under 35 U.S.C. 154(b) by 382 days.

(21) Appl. No.: 10/793,369

(22) Filed: Mar. 4, 2004

(65) Prior Publication Data

US 2005/0194031 A1 Sep. 8, 2005

(51) Int. Cl.
*E04H 15/34* (2006.01)

(52) U.S. Cl. ..... 135/121; 135/141; 135/904; 206/223

(58) Field of Classification Search ..... 135/114, 135/119, 120.3, 121–122, 136, 141–142, 135/904, 909, 138; 206/223, 443
See application file for complete search history.

(56) References Cited

U.S. PATENT DOCUMENTS

| | | | | |
|---|---|---|---|---|
| 1,262,564 | A | 4/1918 | Reynolds | |
| 1,291,758 | A | 1/1919 | Buck | |
| 1,650,323 | A | 11/1927 | Byars | |
| 1,958,296 | A | 5/1934 | Crow | 135/4 |
| 2,022,211 | A | 11/1935 | Leffert | 135/7.1 |
| 2,044,659 | A | 6/1936 | Adams | 135/3 |
| 2,151,908 | A | 3/1939 | Gottlieb | 135/136 |
| 2,182,283 | A | 12/1939 | Curtis | 135/4 |
| 2,440,449 | A | 6/1948 | Raemer | 20/2 |
| 2,448,895 | A | 9/1948 | Lawrence | 135/1 |
| 2,493,749 | A | 1/1950 | Brown et al. | 135/1 |
| 2,513,729 | A | 7/1950 | Lemen | 135/4 |
| 2,523,195 | A | 9/1950 | Comber | 135/3 |
| 2,640,999 | A | 6/1953 | Sheppard | 5/113 |
| 2,690,185 | A | 9/1954 | Pomykala | 135/3 |
| 2,730,259 | A | 1/1956 | Frick | 217/43 |
| 2,764,107 | A | 9/1956 | Niswonger et al. | 108/23 |
| 2,835,406 | A | 5/1958 | Dickerson | 206/65 |
| 2,837,153 | A | 6/1958 | Brown et al. | 160/371 |
| 2,856,941 | A | 10/1958 | O'Neal | |
| 2,860,772 | A | 11/1958 | Northington, Jr. et al. | 206/321 |
| 2,865,386 | A | 12/1958 | Burns | 135/1 |
| 2,905,281 | A | 9/1959 | Zitomer | 189/34 |

(Continued)

FOREIGN PATENT DOCUMENTS

FR 2758583 A1 * 7/1998

(Continued)

OTHER PUBLICATIONS

Ramsey (editor), Architectural Graphic Standards, 1970, John Wiley & Sons, Inc., sixth edition, p. 45 (3 pages).*

*Primary Examiner*—Winnie Yip
(74) *Attorney, Agent, or Firm*—George N. Chaclas; Edwards Angell Palmer & Dodge LLP

(57) ABSTRACT

A method for disassembling and packaging the canopy in a container, wherein the length of the container is 25% shorter than the length of each of the upright assemblies. To accommodate the shortened length, the width and/or the height of the container may be increased as necessary to still house all of the components of the canopy. Preferably, the length of the container is sufficiently short to accommodate placing the container in a traditional sedan automobile trunk.

20 Claims, 14 Drawing Sheets

U.S. PATENT DOCUMENTS 2,908,121 A 10/1959 Enos, Jr. ..... 53/3
2,986,150 A 5/1961 Torian ..... 135/1
3,004,542 A 10/1961 Moody ..... 135/1
3,055,380 A 9/1962 Benka et al. ..... 135/1
3,199,518 A 8/1965 Glidewell ..... 135/4
3,222,841 A 12/1965 Lipof ..... 52/731
3,332,551 A 7/1967 Peterson ..... 206/65
3,375,831 A 4/1968 Serbus ..... 135/1
3,453,786 A 7/1969 Rebarchek ..... 52/63
3,708,199 A * 1/1973 Throssell ..... 296/164
3,952,463 A 4/1976 Lane ..... 52/63
3,957,069 A 5/1976 Denaro ..... 135/15
3,996,706 A 12/1976 Bomgaars ..... 52/71
D246,096 S 10/1977 Trumley ..... D11/145
4,051,626 A 10/1977 Trumley et al. ..... 47/17
4,051,638 A 10/1977 Heintz ..... 52/63
4,070,846 A 1/1978 Sohlberg ..... 52/641
4,074,682 A 2/1978 Yoon ..... 135/4
4,102,307 A 7/1978 Cusick et al.
4,462,612 A 7/1984 Dreyer et al.
D277,228 S 1/1985 Blesch ..... D23/138.2
4,557,311 A 12/1985 Reining ..... 160/330
4,561,227 A 12/1985 Austin ..... 52/236
4,566,729 A 1/1986 Magnino ..... 296/159
4,588,227 A 5/1986 Austin ..... 297/440
4,607,656 A 8/1986 Carter ..... 135/145
4,630,627 A 12/1986 Windows et al. ..... 135/97
4,640,061 A 2/1987 Trumley ..... 52/71
4,641,676 A 2/1987 Lynch ..... 135/145
4,779,635 A 10/1988 Lynch ..... 135/97
4,793,371 A * 12/1988 O'Ferrell et al. ..... 135/119
4,817,655 A 4/1989 Brooks ..... 135/121
4,924,896 A 5/1990 Carter ..... 135/90
4,947,884 A 8/1990 Lynch
5,035,253 A 7/1991 Bortles
5,224,306 A 7/1993 Cramer ..... 52/63
5,244,001 A 9/1993 Lynch ..... 135/145
5,245,802 A 9/1993 Davis ..... 52/86
5,275,188 A 1/1994 Tsai ..... 135/97
5,421,356 A 6/1995 Lynch
5,450,889 A 9/1995 Jones et al. ..... 160/38
5,485,863 A 1/1996 Carter ..... 135/145
5,490,532 A 2/1996 Malloookis et al. ..... 135/117
5,490,533 A 2/1996 Carter ..... 135/145
5,509,713 A 4/1996 Hou ..... 296/138
5,511,572 A 4/1996 Carter ..... 135/145
5,520,236 A 5/1996 Thomas et al. ..... 160/120
5,555,681 A 9/1996 Cawthon ..... 52/63
5,598,668 A 2/1997 Isom ..... 52/86
5,617,681 A 4/1997 Lyons ..... 52/82
5,632,292 A 5/1997 Carter ..... 135/145
5,632,293 A 5/1997 Carter ..... 135/145
5,634,483 A 6/1997 Gwin ..... 135/131
5,634,638 A 6/1997 Havens et al. ..... 473/421
5,638,853 A 6/1997 Tsai
5,660,002 A 8/1997 Lashinger
5,701,923 A 12/1997 Losi, Jr. et al. ..... 135/131
5,730,281 A 3/1998 Powell et al. ..... 206/223
D397,445 S 8/1998 Thorbeck et al. ..... D25/32
5,794,640 A 8/1998 Jang et al.
5,797,412 A 8/1998 Carter ..... 135/145
5,802,647 A 9/1998 Helmsderfer ..... 5/947
5,813,425 A 9/1998 Carter ..... 135/145
5,819,474 A 10/1998 Strom ..... 52/4
5,845,423 A 12/1998 Hicks ..... 40/603
D409,310 S 5/1999 Goldwitz ..... D25/1
5,901,522 A 5/1999 Slater ..... 52/641
5,918,615 A 7/1999 Stuck, Sr. ..... 135/135
5,921,260 A 7/1999 Carter ..... 135/145
5,934,301 A 8/1999 Carter ..... 135/145
5,944,085 A 8/1999 Malott ..... 160/67
D414,564 S 9/1999 Goldwitz ..... D25/61
D415,571 S 10/1999 Goldwitz ..... D25/1
D415,572 S 10/1999 Goldwitz ..... D25/56
6,041,800 A 3/2000 Carter
6,062,243 A 5/2000 Tuch et al. ..... 135/124
6,070,604 A 6/2000 Carter ..... 135/145
6,076,312 A 6/2000 Carter ..... 52/145
D430,306 S 8/2000 Goldwitz ..... D25/61
6,098,335 A 8/2000 Brown, Jr.
6,129,102 A 10/2000 Carter ..... 135/145
6,141,902 A 11/2000 Boice ..... 47/17
6,155,280 A 12/2000 Powell et al. ..... 135/124
6,170,503 B1 * 1/2001 Shy ..... 135/119
6,173,726 B1 1/2001 Talmadge ..... 135/144
6,192,643 B1 2/2001 Zadok
6,196,245 B1 * 3/2001 Eastman ..... 135/121
6,367,495 B1 4/2002 Powell et al. ..... 135/122
6,505,638 B1 1/2003 Powell et al. ..... 135/124
6,508,262 B1 1/2003 Takayama et al.
6,666,223 B2 12/2003 Price et al.
6,684,584 B1 2/2004 Goldwitz ..... 52/222
6,988,505 B2 1/2006 Powell et al.
7,055,538 B2 6/2006 Deng et al.

FOREIGN PATENT DOCUMENTS

FR 2849668 A1 7/2004

* cited by examiner

SYSTEM AND METHOD FOR STORING, ASSEMBLING AND TRANSPORTING A CANOPY

CROSS-REFERENCE TO A RELATED APPLICATION

This application relates to U.S. patent application Ser. No. 10/282,283, filed Oct. 28, 2002 and published as US 2003/0084934 A1, which is incorporated herein by reference.

BACKGROUND OF THE INVENTION

1. Field of the Invention

The subject disclosure relates to systems and methods for assembling and packing canopies, and more particularly to improved systems and methods for reducing the size of a container required to store, display and transport one or more canopies.

2. Background of the Related Art

Use of canopies to protect a variety of items from the elements has been widely used and well understood in the art. Typical items include cars, boats, recreational vehicles, and picnic tables just to name a few. Some examples of packages for canopies are illustrated in U.S. Pat. Nos. 5,730,281; 6,141,902; and 6,679,009 each of which is incorporated herein by reference in its entirety. The prior art illustrates a canopies, greenhouses and shelters being packed in container. Packaged, the containers vary in size from 11 inches×6.5 inches×70 inches to 10 inches×11 inches×86 inches to 84 inches×96 inches×48 inches. None of the prior art containers for such buildings can be efficiently packaged for transport by the manufacturer, attractively displayed in a variety of locations by the retailer or transported in the trunk of a traditional sedan automobile by the purchaser. For instance, a 70 inch container cannot be easily displayed at the end of an aisle by the retailer. With a 70 inch container, a portion of the 70 inch container extends out of the trunk of a sedan automobile for transport.

There is a need, therefore, for an improved storage and assembly system and method which permits compact storage and transport while still allowing easy assembly, and aids in assuring adequate structural integrity when assembled.

SUMMARY OF THE INVENTION

In a preferred embodiment, a canopy kit stores, transports and assembles such that the canopy kit can be easily manufactured, displayed and purchased. The canopy kit includes four vertical posts, each vertical post including a first portion removably connectable to a second portion, three horizontal cross rails, each horizontal cross rail including a first portion removably connectable to a second portion, and four arch cross rails, each arch cross rail including a first portion removably connectable to a second portion. The canopy kit also includes a plurality of frame connectors for connect the horizontal and arch cross rails to form a frame for a peaked roof, and mounting the frame on the four vertical posts. A tarp of the canopy kit is for covering the frame of the peaked roof. The canopy kit also includes means for attaching the tarp to the frame of the peaked roof and an elongated box having a length, a width and a height. The length being sufficient to house the first and second portions of the vertical posts, horizontal cross rails and arch cross rails, and the width and the height being sufficient to house the plurality of frame connectors, the tarp and the means for attaching.

In another preferred embodiment, a canopy kit includes six vertical posts, each vertical post including a first portion removably connectable to a second portion, six horizontal cross rails, each horizontal cross rail including a first portion removably connectable to a second portion, and six arch cross rails, each arch cross rail including a first portion removably connectable to a second portion. The canopy kit also includes a plurality of frame connectors for connecting the horizontal and arch cross rails to form a frame for a peaked roof, and mounting the frame on the six vertical posts as well as a tarp for covering the frame of the peaked roof. Means for attaching the tarp to the frame of the peaked roof and an elongated box having a length, a width and a height are also included in the canopy kit. The length of the elongated box is at least 25% shorter than a full length of the vertical posts, and the width and the height are sufficient to house the plurality of frame connectors, the tarp, the horizontal cross rails, the arch cross rails, and the means for attaching.

It is an aspect of the subject disclosure to provide a method for boxing a canopy so that the box can be easily transported, stored and displayed while reducing the likelihood of damage to the components of the canopy.

In one embodiment, the first and second portions of the vertical posts, horizontal cross rails and arch cross rails are approximately 41 inches and the length of the elongated box is approximately 42 inches. Preferably, the assembled canopy is about 9 feet wide by about 9 feet deep, wherein the horizontal cross rails are about 6 feet above the base feet.

It should be appreciated that the present invention can be implemented and utilized in numerous ways. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be had to the drawings wherein.

DETAILED DESCRIPTION OF PREFERRED EMBODIMENTS

Figure 1:
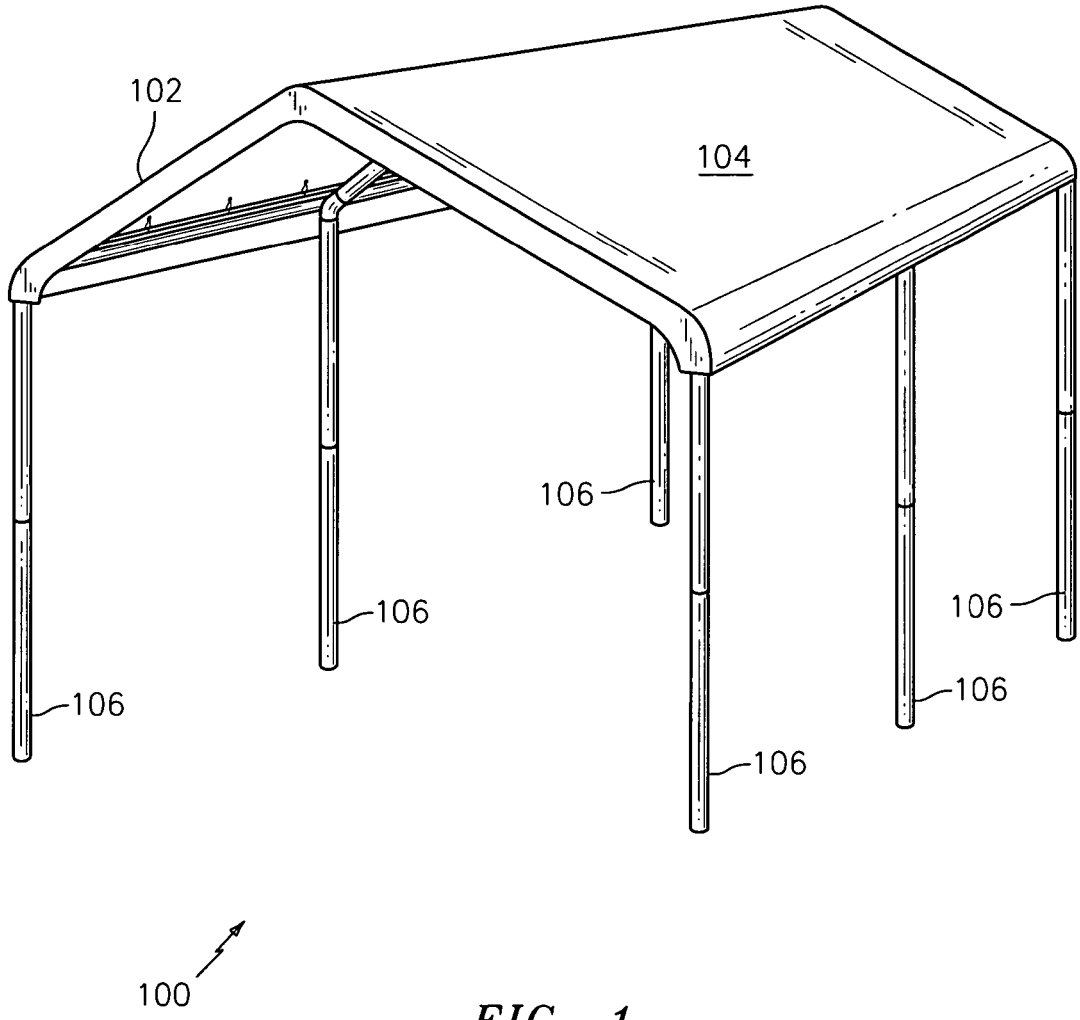
FIG. 1 is a perspective view of an assembled canopy constructed in accordance with the subject disclosure.

The present invention overcomes many of the prior art problems associated with kits for housing canopies. The advantages, and other features of the system disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

Referring to FIG. 1, an assembled canopy is referred to generally by the reference numeral 100. The canopy 100 provides shelter from the elements yet can be easily assembled and deconstructed for easy storage, transport and display. In a preferred embodiment, the canopy 100 is 10 feet wide by 20 feet long by 9.5 feet high. The canopy 100 includes a roof frame portion 102 covered by a resilient tarp 104. In a preferred embodiment, the tarp 104 is attached to the roof frame portion 102 by ball bungee cords 124 as shown in U.S. patent application Ser. No. 10/282,283 filed Oct. 28, 2002 and published as U.S. Patent Application No. 2003/0084934 A1 on May 8, 2003, which is incorporated herein by reference in its entirety. The roof frame portion 102 is supported by six upright assemblies 106.

Figure 2:
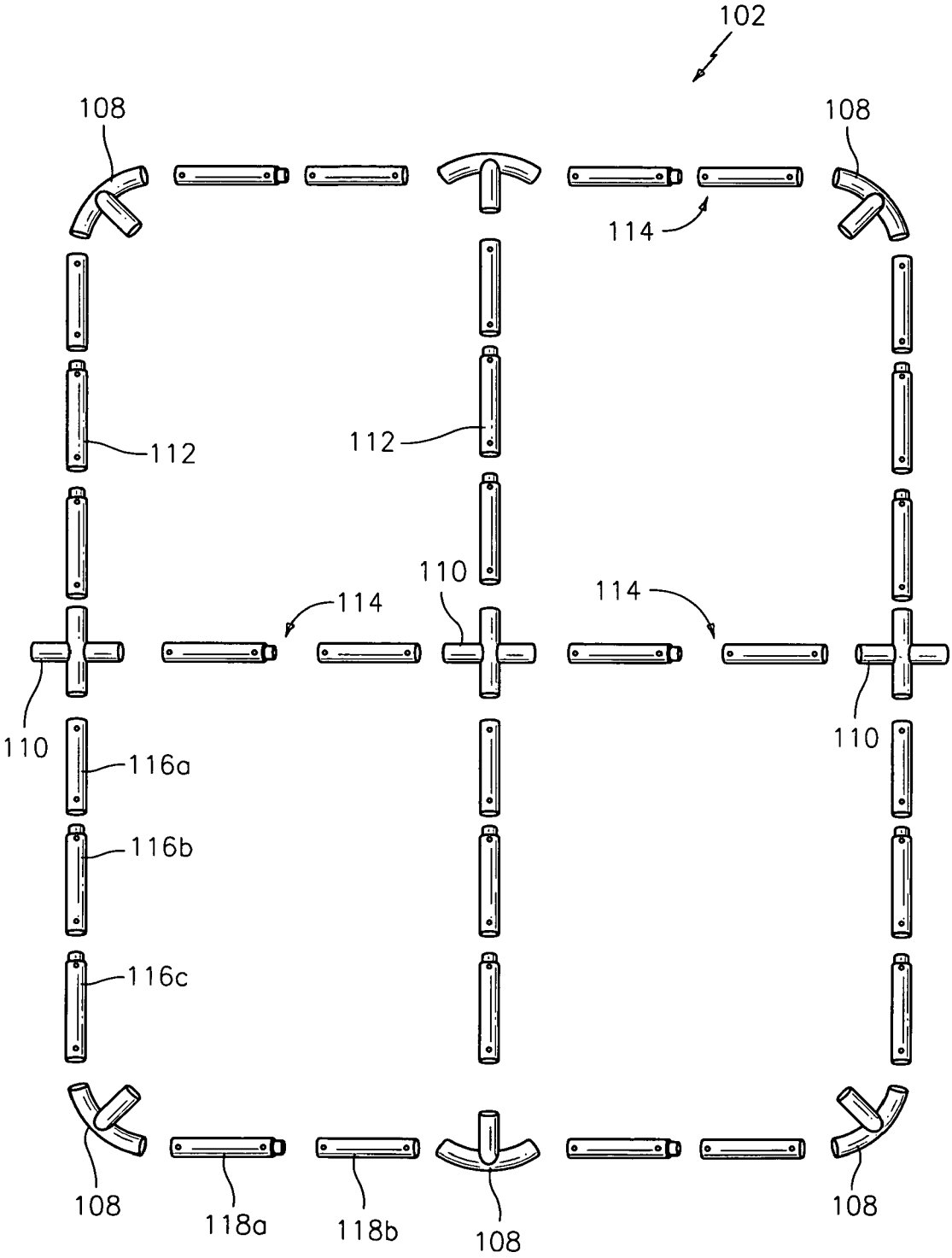
FIG. 2 is an exploded view of the roof frame portion of the canopy of FIG. 1.

Referring to FIG. 2, roof frame portion 102 includes a plurality of 3-way connectors 108 and 4-way connectors 110 for interconnecting horizontal rail assemblies 112 and arch rail assemblies 114. Preferably, the connectors 108, 110 are sized to receive the rail assemblies 112, 114 and define holes for receiving push button devices mounted on the rail assemblies 112, 114. The horizontal rail assemblies 112 include three portions 116*a-c*. Portions 116*b* and 116*c* have smaller necks with push button devices to facilitate insertion and coupling. The arch rail assemblies 114 include two portions 118*a* and 118*b*. Similar to the horizontal rail assemblies 112, the two portions 118*a* and 118*b* of the arch rail assemblies 114 have smaller necks with push buttons. For simplicity and clarity, only enough reference numerals with tag lines that are sufficient for understanding have been shown.

Figure 3:
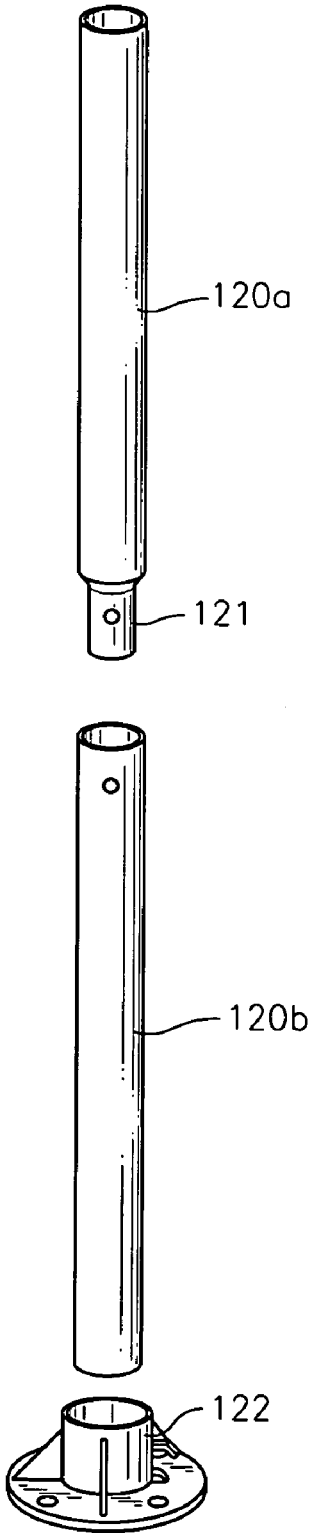
FIG. 3 is an exploded view of an upright assembly of the canopy of FIG. 1.
Figure 3A:
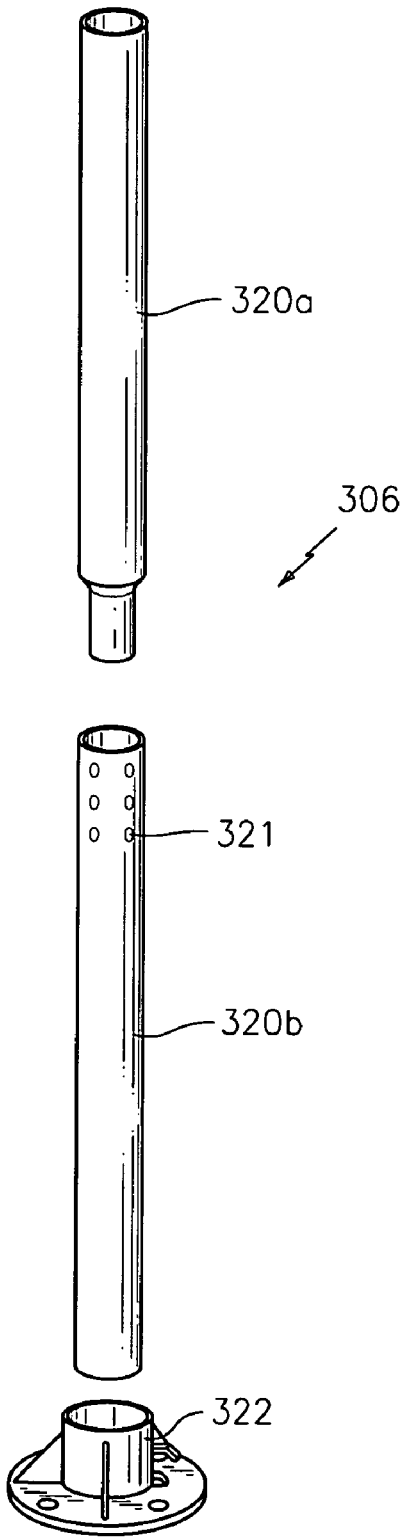
FIG. 3A is an exploded view of an upright assembly of another canopy constructed in accordance with the subject disclosure.

Referring now to FIG. 3, an upright assembly 106 has two tubular portions 120*a* and 120*b* that interconnect by insertion. To accomplish the insertion, tubular portion 120*a* has a smaller neck with a push button device 121 for engaging a hole defined by the tubular portion 120*b*. A base foot 122 is sized and configured to receive the tubular portion 120*b* when assembled. Referring now to FIG. 3A, an alternative upright assembly 306 has two tubular portions 320*a* and 320*b* that interconnect by insertion. To accomplish a friction fit when inserted, tubular portion 320*a* has a smaller neck and a plurality of protrusions 321 on portion 320*b* create sufficient friction to selectively hold portions 320*a* and portion 320*b* together. It is also envisioned that screws, telescoping portions, threads and other like fastening means known to those of ordinary skill in the pertinent art may be utilized to secure components.

Referring now to FIGS. 4-12, a method for disassembling and packaging the canopy 100 in a container 200 is shown. The method includes reducing the length of each of the upright assemblies 106, horizontal rail assemblies 112 and arch rail assemblies 114 by approximately half or thirds. As a result, the length A of the container 200 can be shortened commensurately as compared with prior art containers. To accommodate the shortened length A, the width B and/or the height C of the container 200 may be increased as necessary to still house all of the components of the canopy 100. Preferably, the length is 42 inches or less to accommodate placing the container 200 in a traditional sedan automobile trunk.

Figure 4:
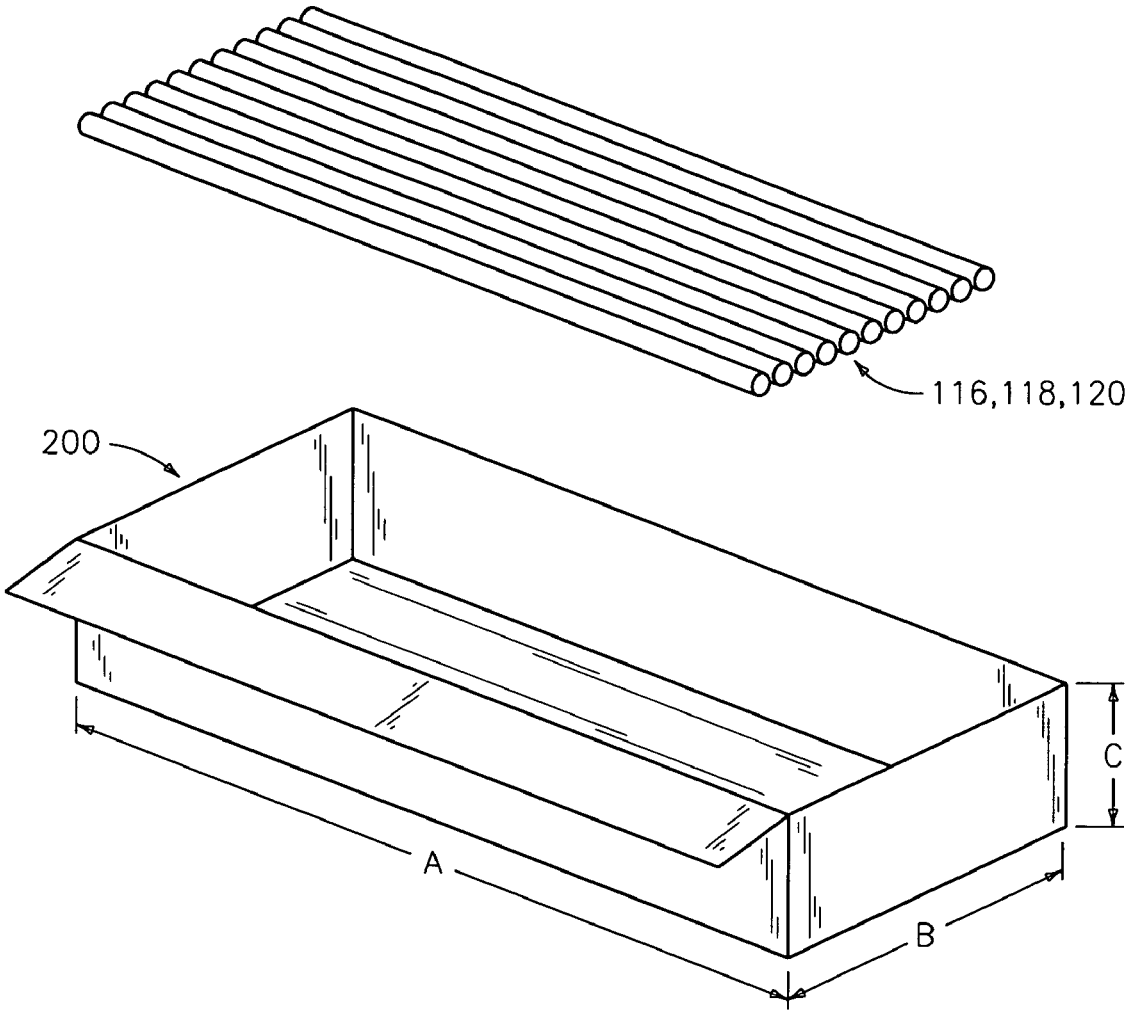
FIGS. 4-12 are a sequence of perspective views illustrating a method for packing the canopy of FIG. 1 in a container.
Figure 5:
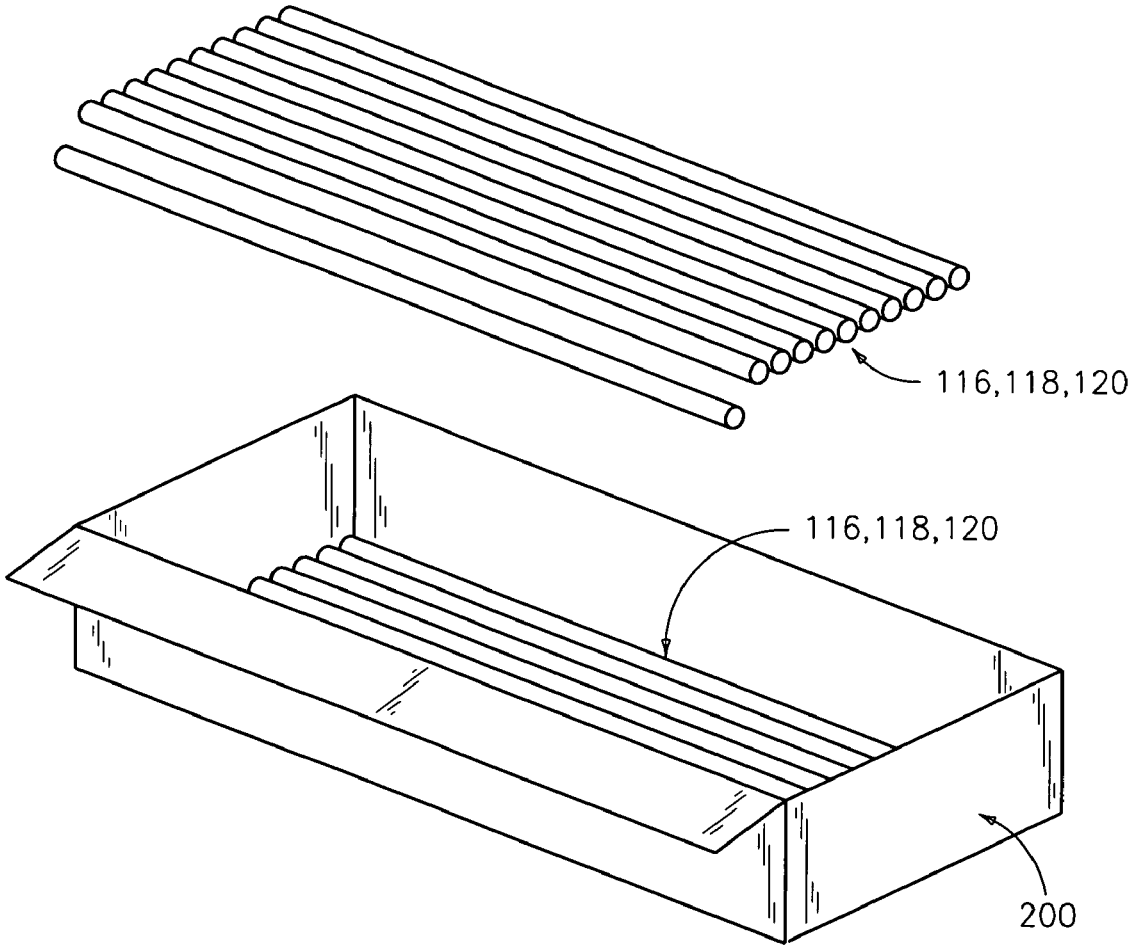
Figure 13:
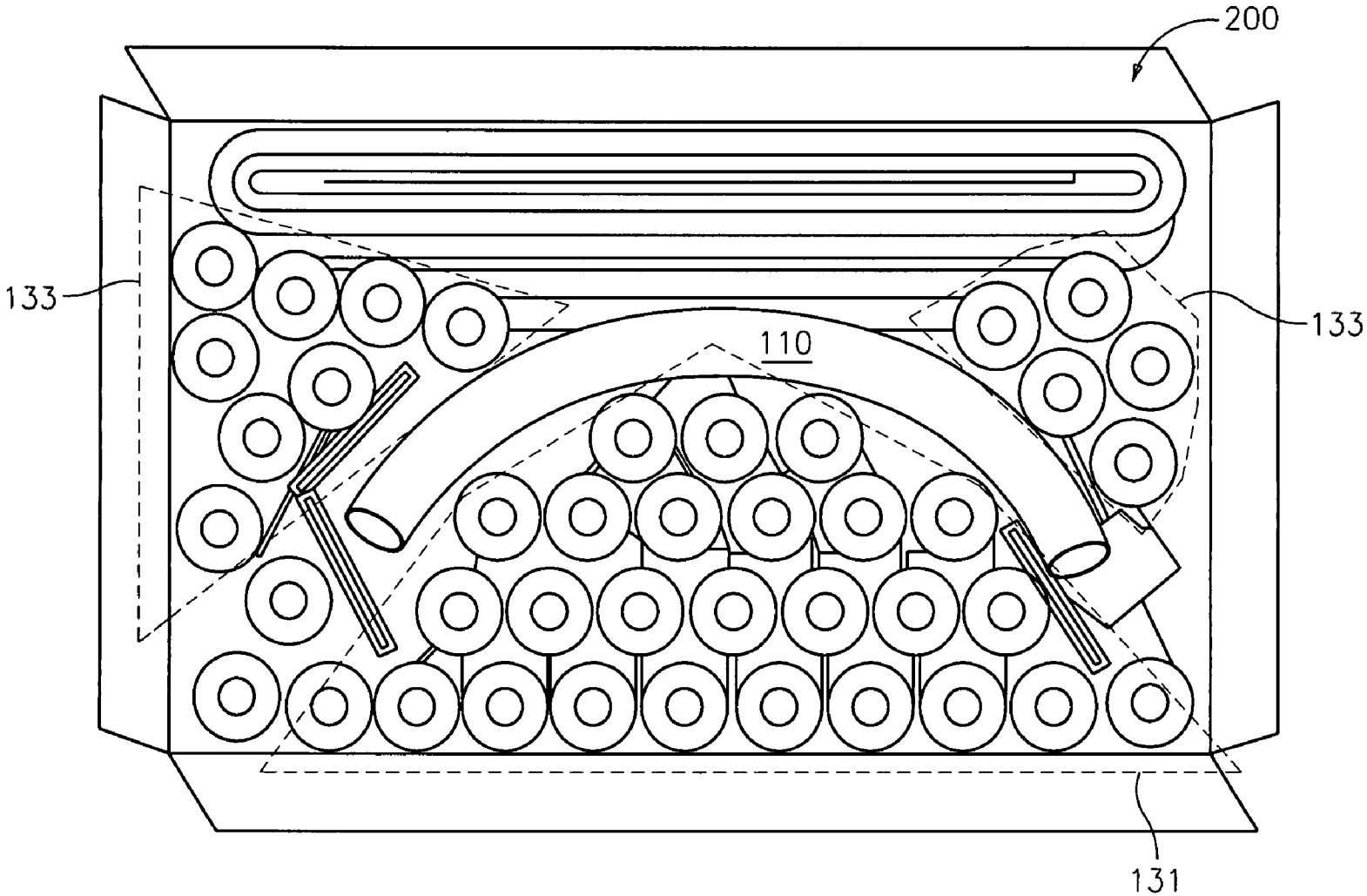
FIG. 13 is a cross-sectional view of a container filled by the sequence of FIGS. 4-12.

Referring now to FIGS. 4 and 5, an empty container 200 receives several rows of tubular pipes. These tubular pipes may be tubular portions 120*a* and 120*b* of the upright assemblies 106, portions 116*a-c* of the horizontal rail assemblies 112, portions 118*a* and 118*b* of the arch rail assemblies 114, and combinations thereof. In a preferred embodiment, the bottom of the container 200 has four layers of pipes thereon, wherein each layer has fewer pipes than the preceding to form a roughly triangular cross-sectional shape 131 as outlined in FIG. 13.

Figure 6:
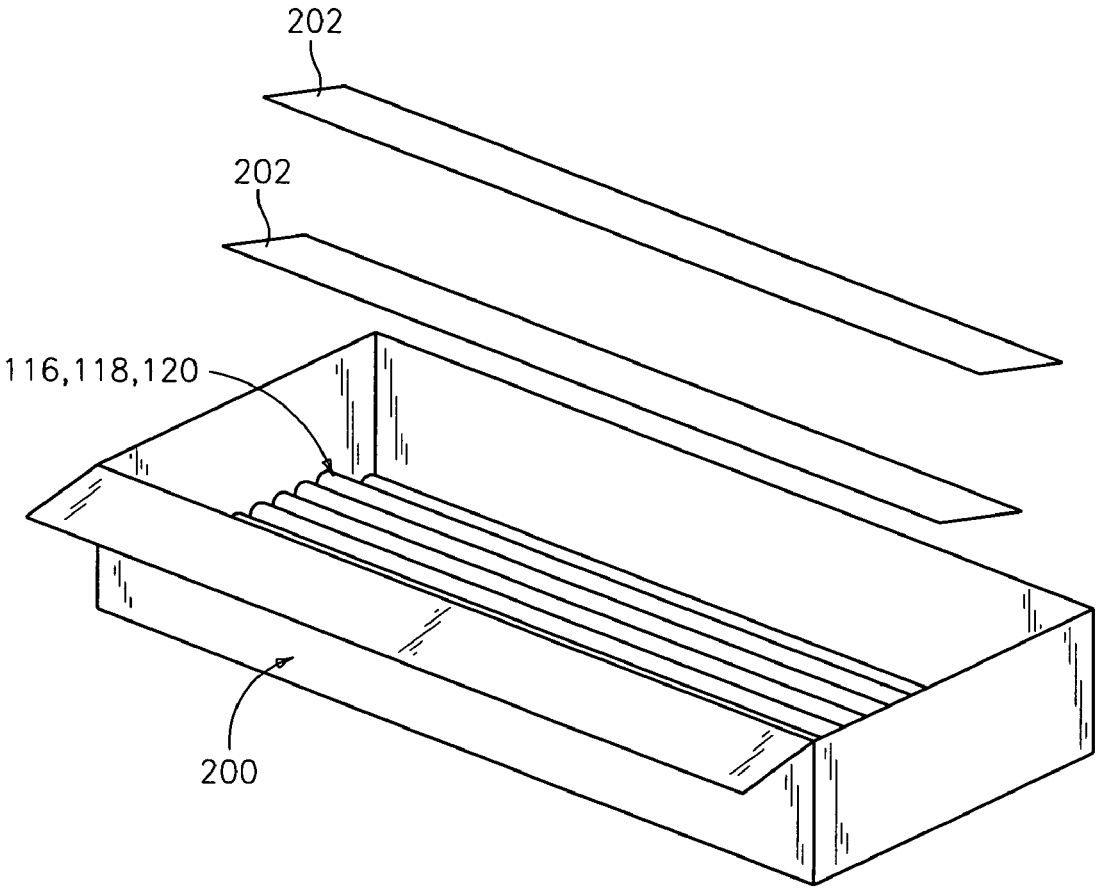
Figure 7:
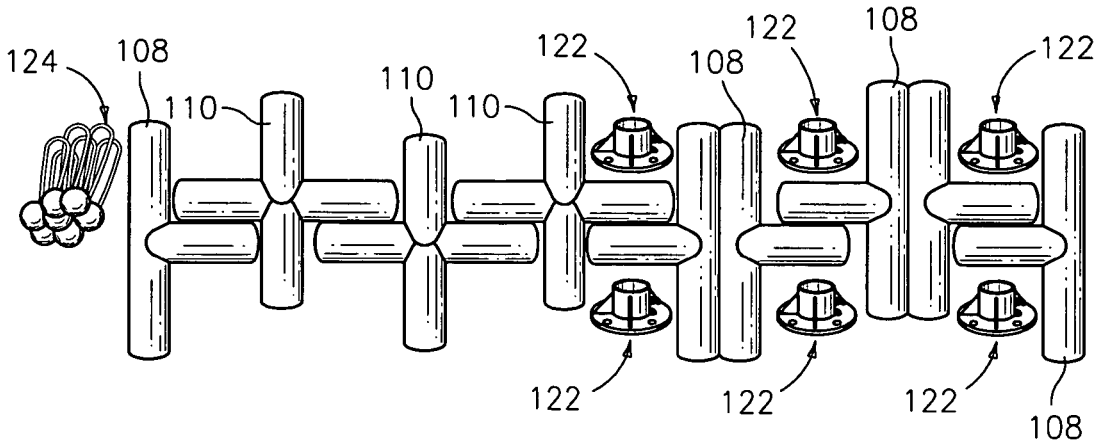
Figure 7:
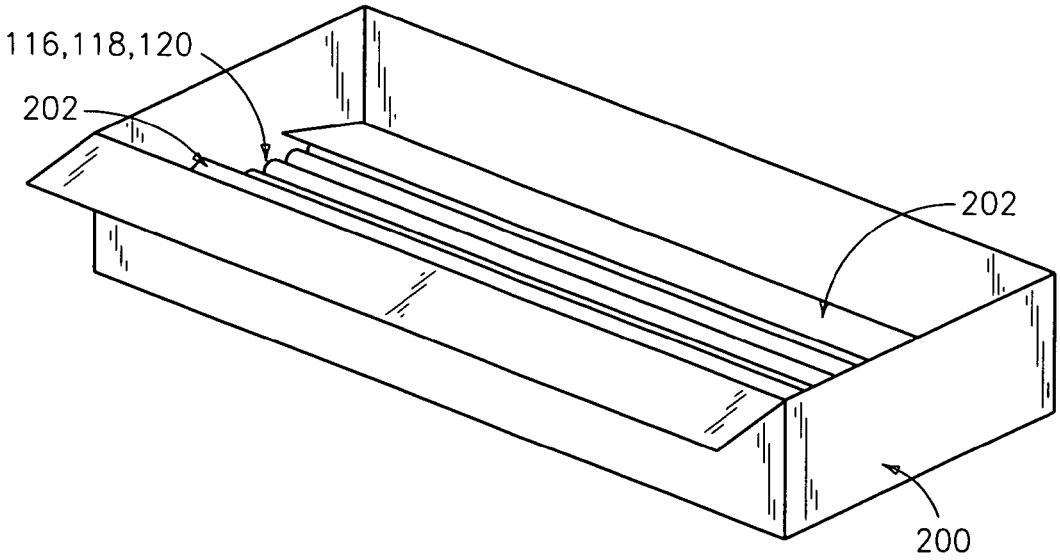

Referring to FIGS. 6 and 7, two strips 202 are placed onto the pipes in order to help maintain the roughly triangular cross-sectional shape. Preferably, the strips 202 are cardboard. Next, the plurality of 3-way connectors 108 and 4-way connectors 110 are placed into the container 200 along with the base feet 122 and ball bungee cords 124. In a preferred embodiment, the plurality of frame connectors 108, 110 are nested in a line for reducing a length of the line and covered by at least a portion of the eight vertical posts, the eight horizontal cross rails and the six arch cross rails. As shown in FIG. 7, in order to nest the frame connectors 108, 110, the axis of each connector 110 is offset along the length of the container 200 with respect to the adjacent connector 108, 110. For adjacent, three-way connectors 108, the axis may be offset or the three-way connectors may be arranged back to back. As a result, shifting that may damage the tarp or other components is prevented.

Figure 8:
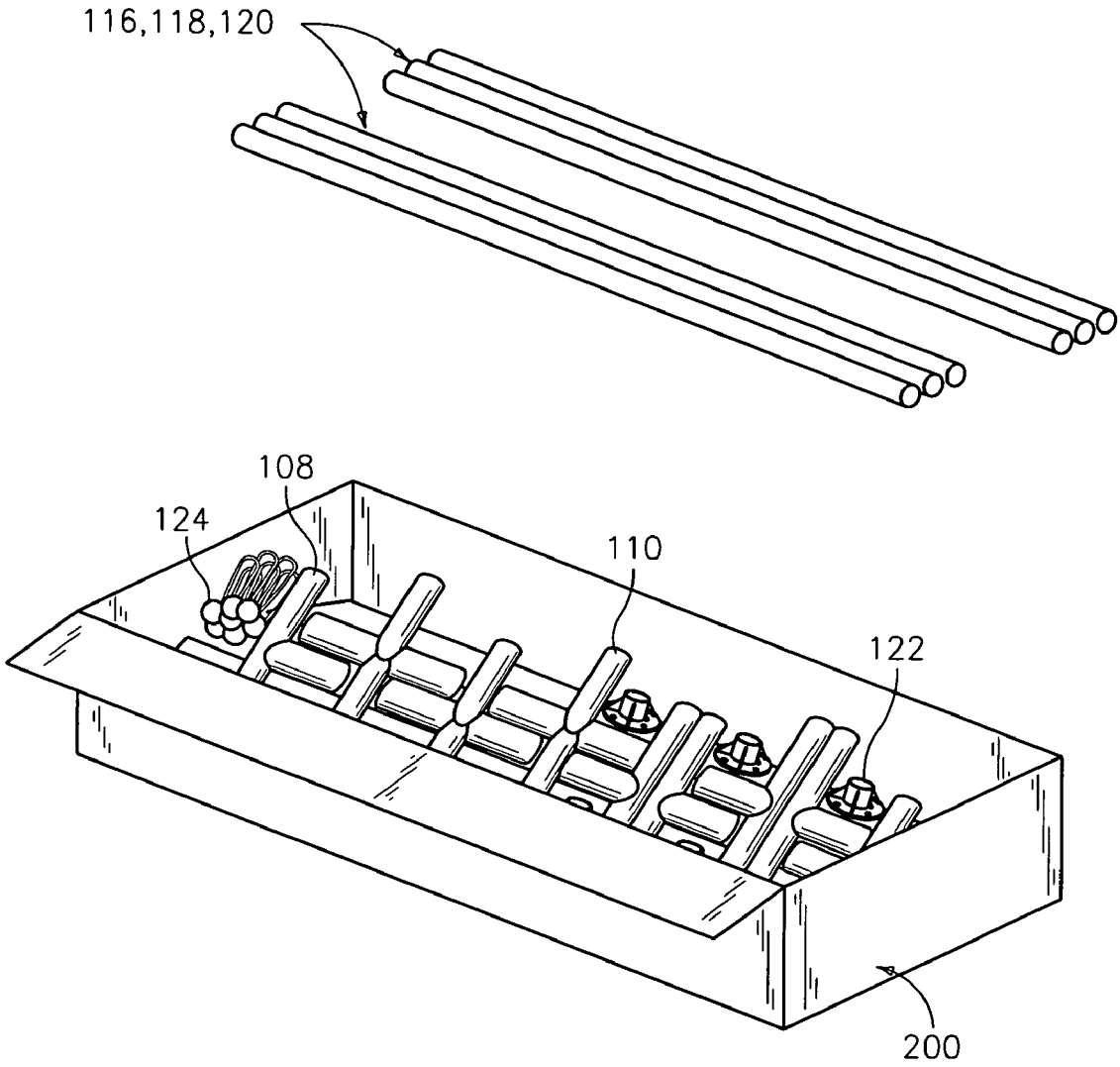
Figure 9:
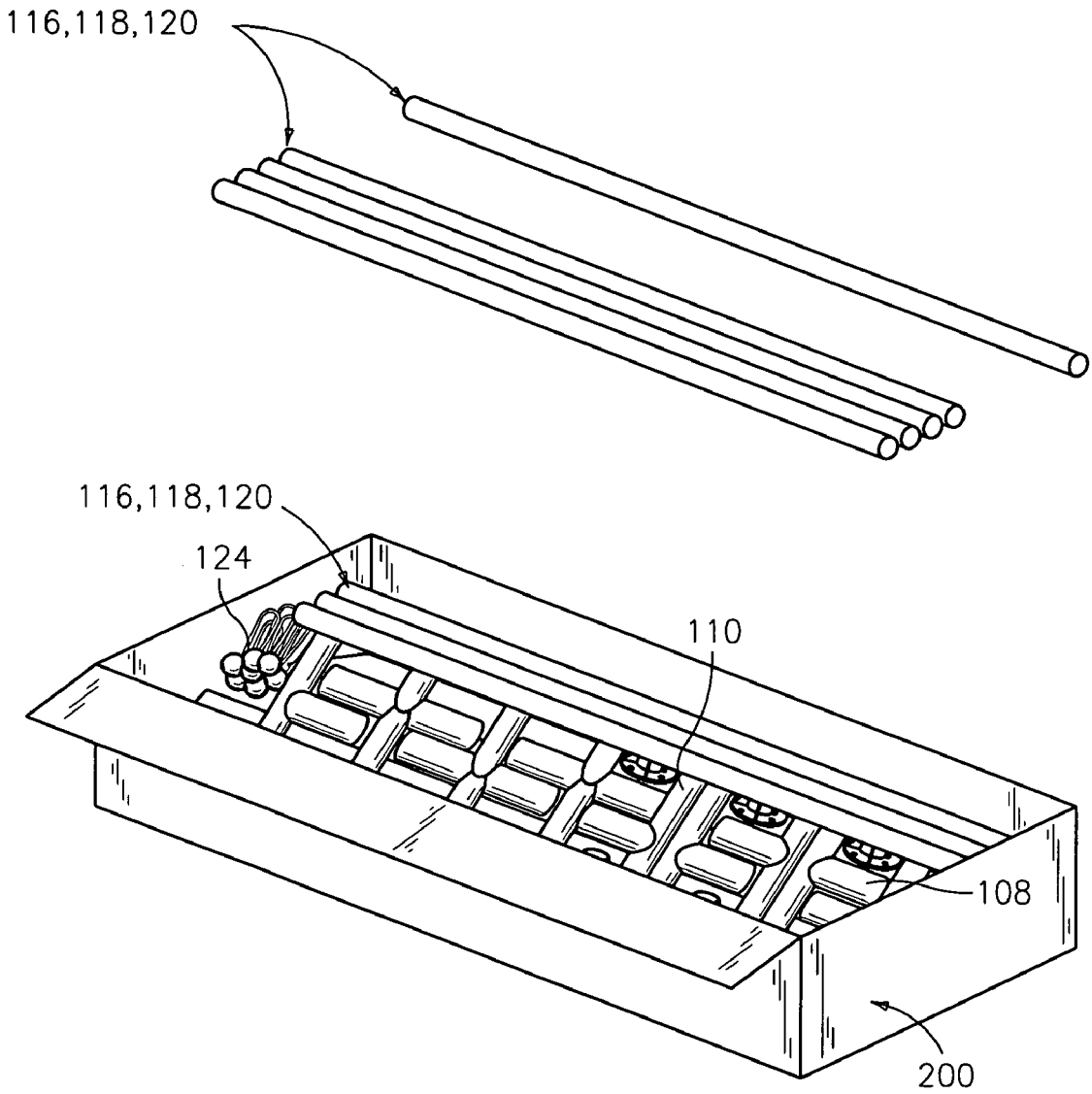
Figure 10:
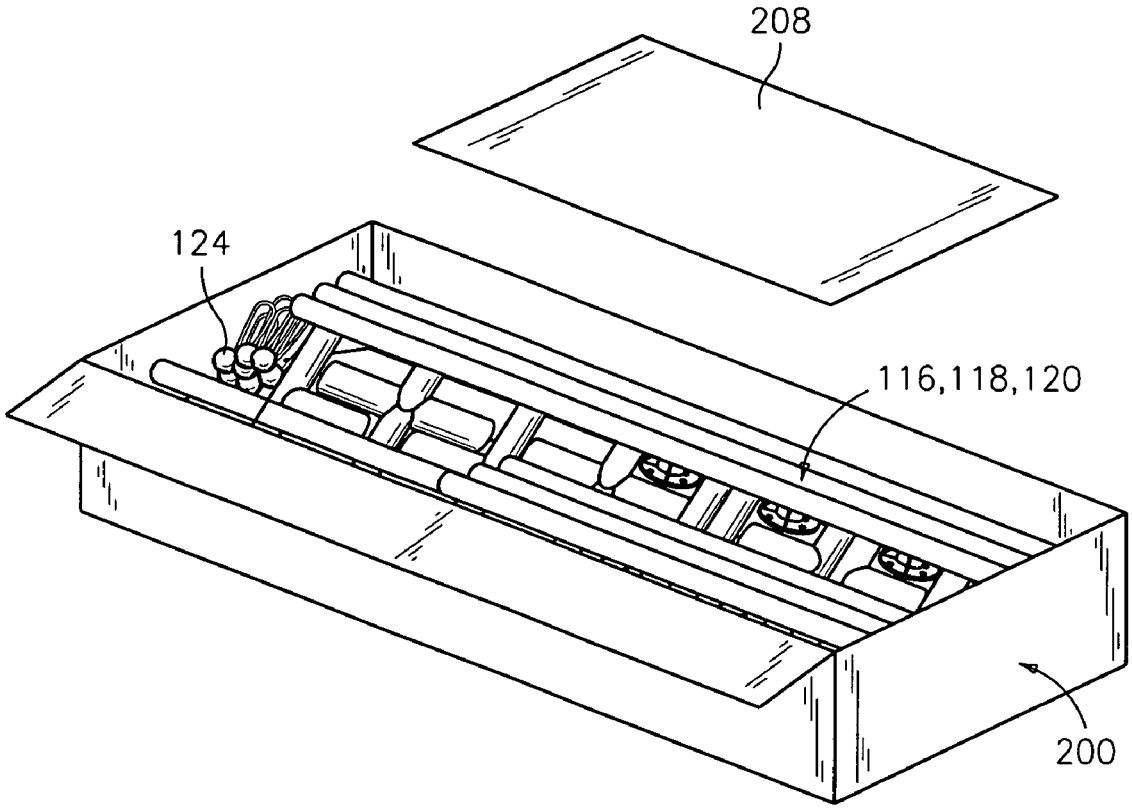
Figure 11:
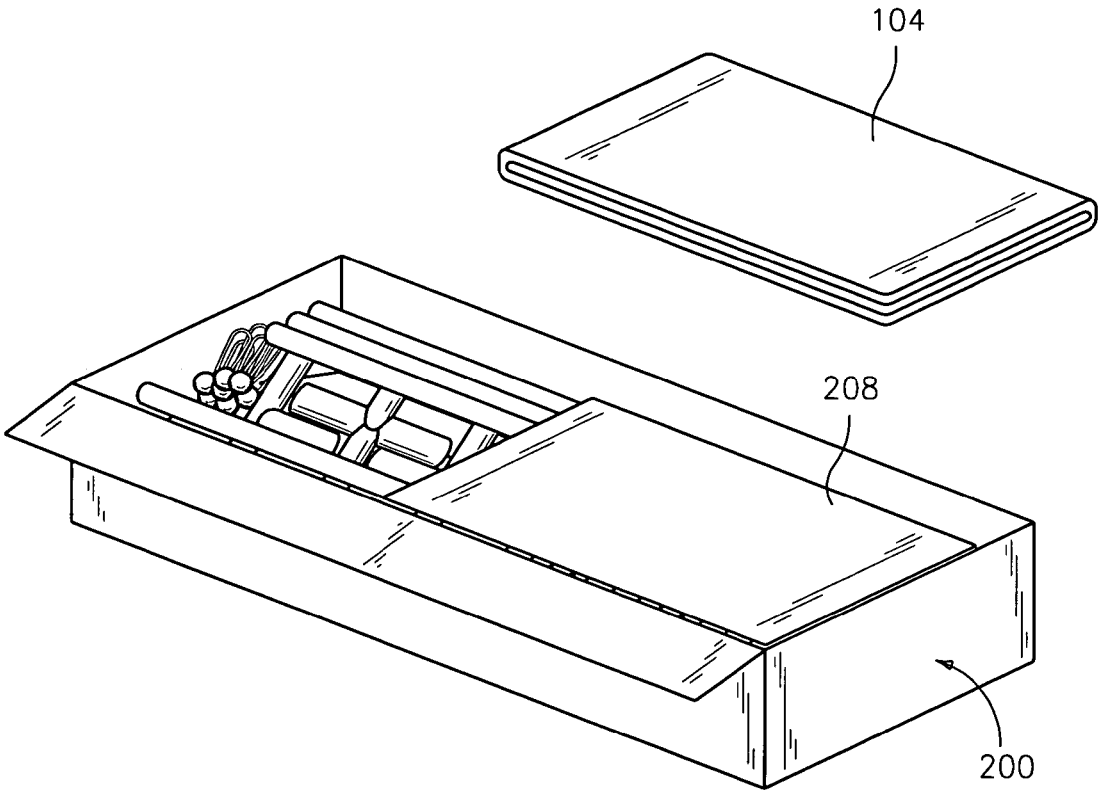
Figure 12:
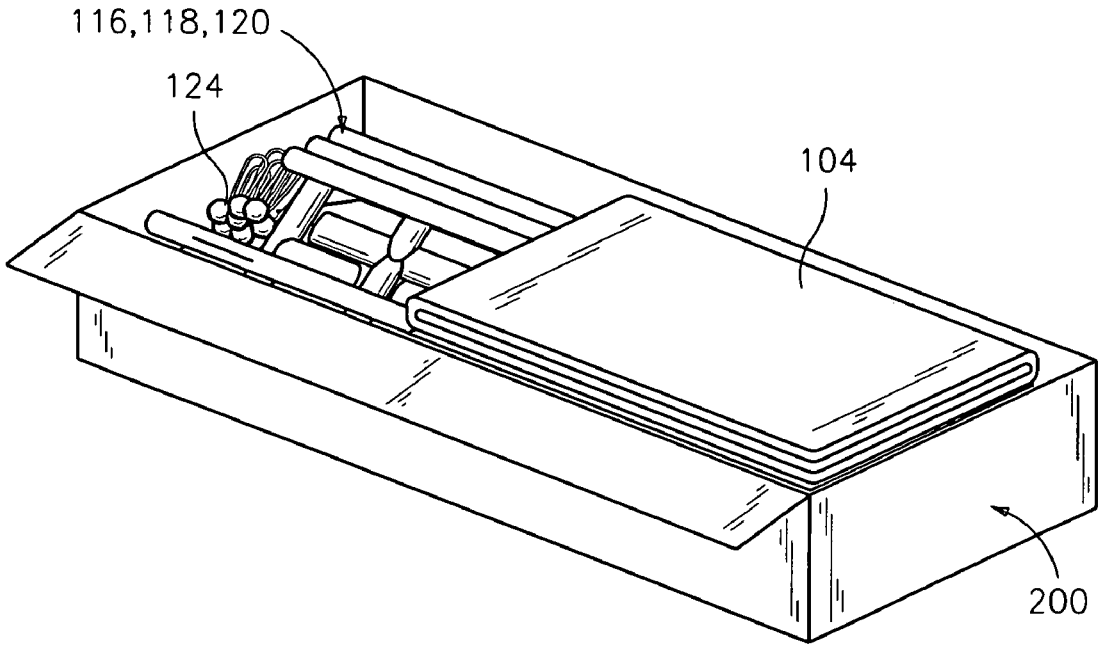

Referring now to FIGS. 8 and 9, the remainder of the pipes required for the canopy 100 are placed on top of the connectors 108 and 110. The remainder of the pipes also form roughly triangular shapes 133 as outlined in FIG. 13. At this point, the components within the container 200 form a roughly rectangular cross-sectional shape. The remainder of the pipes also provide protection for the tarp 104 by separating the tarp 104 from the edges of the connectors 108, 110 that may cut or otherwise damage the tarp 104 during shifting and jostling of the components. Referring to FIGS. 10, 11 and 12, a large strip 208 is placed into the container 200. Preferably,.the large strip 208 is cardboard for.protecting the tarp 104 from damage. The tarp 104 is placed onto the large strip 208 and the container 200 can be sealed for storage, transport and display. The various components such as the tarp 104, ball bungee cords 124 and any required loose hardware may be bagged and also placed in the container 200.

In a preferred embodiment, the container 200 when packaged is 42 inches by 16.5 inches by 10 when holding a 10×20×9.5 foot canopy 100. The two portions 118*a* and 118*b* of the arch rail assemblies 114 are 41 inch and 25.75 inch tubes, respectively. The three portions 116*a-c* of the horizontal rail assemblies 112 are 41 inch tubes. The tubular portions 120*a* and 120*b* of the upright assemblies 106 are 41 inch and 40 inch tubes, respectively. It is envisioned that the components of the canopy may be fabricated from steel, aluminum, plastic, polyvinyl chloride or PVC, polyethylene and combinations thereof.

Figure 14:
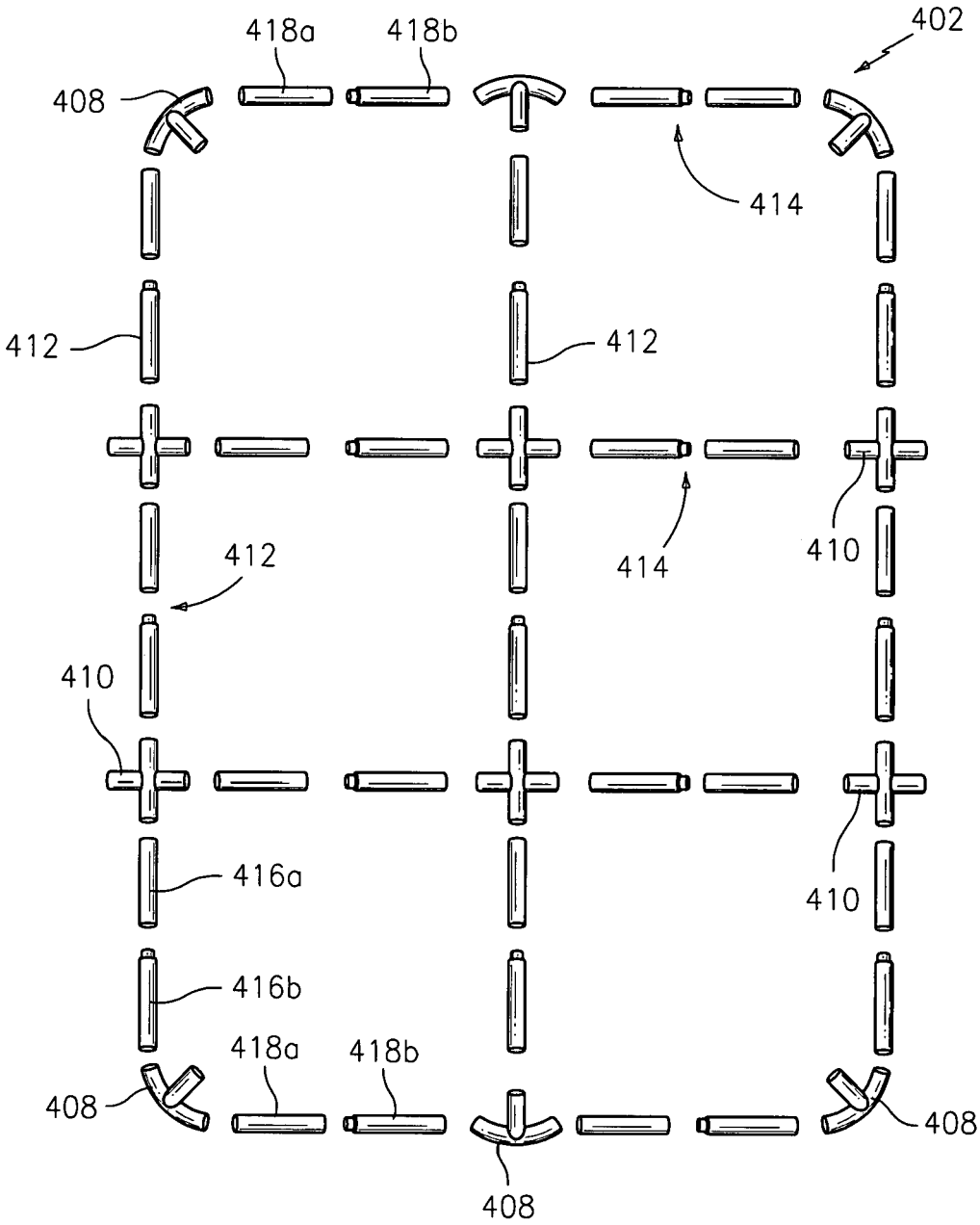
FIG. 14 is an exploded view of a roof frame portion of an eight legged canopy constructed in accordance with the subject disclosure.

Referring now to FIG. 14, as will be appreciated by those of ordinary skill in the pertinent art, the roof frame portion 402 utilizes the same principles of the roof frame portion 102 described above. Accordingly, like reference numerals preceded by the numeral "4" instead of the numeral "1", are used to indicate like elements. The horizontal rail assemblies 412 include two portions 416*a* and 416*b*. In a preferred embodiment, a length of the horizontal rail assemblies 412 is 10 feet and each portion 416*a* and 416*b* is approximately 60 inches long. Consequently, a container for storing the portions 416*a* and 416*b* is approximately 60 inches in length. As a result, if a preferred upright assembly is approximately 80 inches, the length of the container for storage is approximately 75% of the upright assembly.

Figure 14A:
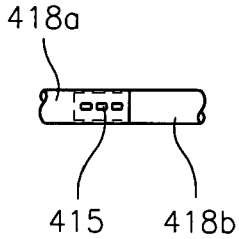
FIG. 14A is a detailed view of two interconnection portions of the roof frame of FIG. 14.

Circle A of FIG. 14A shows another preferred method for interconnecting portions of the roof frame portion 402 or upright assemblies 120*a*, 120*b*. Each portion 418*a* and 418*b* of the arch rail assemblies 414 include two portions 118*a* and 118*b*, each portion having a crimped section 415 to provide an interference fit between the portions 118*a* and 118*b* when engaged.

While the invention has been described with respect to preferred embodiments, those skilled in the art will readily appreciate that various changes and/or modifications can be made to the invention without departing from the spirit or scope of the invention as defined by the appended claims.

What is claimed is:

1. A canopy kit for storage, transport and assembly, the canopy kit comprising:

four vertical posts, each vertical post including a first portion operatively connectable to a second portion for erecting such that a length of the four vertical posts can be selectively changed to a reduced length;

three horizontal cross rails, each horizontal cross rail including a first portion removably connectable to a second portion;

four arch cross rails, each arch cross rail including a first portion removably connectable to a second portion;

a plurality of frame connectors for connecting the horizontal and arch cross rails to form a frame for a peaked roof, and mounting the frame on the four vertical posts;

a tarp for covering the frame of the peaked roof;

means for attaching the tarp to the frame of the peaked roof; and an elongated box having a length, a width and a height, the elongated box length based on the reduced length to be sufficient to house the first and second portions of the vertical posts, horizontal cross rails and arch cross rails, wherein the elongated box length is approximately equal to the reduced length for transport in a car trunk and the width and the height being sufficient to house the plurality of frame connectors, the tarp and the means for attaching.

2. A canopy kit as recited in claim 1, wherein the first and second portions of the vertical posts, horizontal cross rails and arch cross rails are approximately 41 inches and the length of the elongated box is approximately 42 inches.

3. A canopy kit as recited in claim 2, further comprising a third portion of each of the three horizontal cross rails, the third portion for extending a length of the three horizontal cross rails and removably connectable to the second portion thereof.

4. A canopy kit as recited in claim 1, further comprising four base feet connectable to the first portion of the four vertical posts for stabilizing each vertical post and a strip below the tarp for protecting the tarp from the posts, rails, connectors, and means for attaching underneath the strip, wherein the tarp is solely between the strip and the elongated box.

5. A canopy kit as recited in claim 4, wherein a canopy assembled from the canopy kit is at least 9 feet wide by at least 9 feet long, wherein the horizontal cross rails are at least 6 feet above the base feet.

6. A canopy kit as recited in claim 1, wherein the means for attaching is a ball bungee cord.

7. A canopy kit as recited in claim 1, wherein the first portions of the vertical posts, horizontal cross rails and arch cross rails have a smaller neck for insertion with the corresponding second portions of the vertical posts, horizontal cross rails and arch cross rails.

8. A canopy kit as recited in claim 7, further comprising means on the second portions of the vertical posts, horizontal cross rails and arch cross rails for engaging a hole formed in the smaller neck of the corresponding first portions of the vertical posts, horizontal cross rails and arch cross rails.

9. A canopy kit as recited in claim 8, wherein the means is a push button device.

10. A canopy kit as recited in claim 1, wherein the frame connectors include three-way connectors and four-way connectors.

11. A canopy kit as recited in claim 1, wherein the length of the elongated box is approximately no more than 75% of a length of the four vertical posts when the vertical posts are assembled.

12. A canopy kit as recited in claim 1, wherein the length of the elongated box is approximately no more than 50% of a length of the four vertical posts.

13. A canopy kit as recited in claim 1, wherein wherein the vertical posts, horizontal cross rails, arch cross rails, and frame connectors are fabricated from steel.

14. A canopy kit for storage, the canopy kit comprising:

six vertical posts, each vertical post including a first portion removably connectable to a second portion;

six horizontal cross rails, each horizontal cross rail including a first portion removably connectable to a second portion;

six arch cross rails, each arch cross rail including a first portion removably connectable to a second portion;

a plurality of frame connectors for connecting the horizontal and arch cross rails to form a frame for a peaked roof, and mounting the frame on the six vertical posts;

a tarp for covering the frame of the peaked roof;

means for attaching the tarp to the frame of the peaked roof; and an elongated box having a length, a width and a height, the length being at least 25% shorter than a full length of the vertical posts and the width and the height being sufficient to house the plurality of frame connectors, the tarp, the horizontal cross rails, the arch cross rails, and the means for attaching.

15. A canopy kit as recited in claim 14, wherein a canopy assembled from the canopy kit is approximately 10 feet wide by approximately 20 feet long by approximately 9.5 feet high.

16. A canopy kit as recited in claim 15, wherein the length of the elongated box is approximately 60 inches.

17. A canopy kit as recited in claim 15, wherein the length of the elongated box is approximately 42 inches.

18. A canopy kit for storage, the canopy kit comprising:

eight vertical posts, each vertical post including means for reducing a length thereof by at least 20%;

eight horizontal cross rails, each horizontal cross rail including means for reducing a length thereof;

six arch cross rails, each arch cross rail including means for reducing a length thereof;

a plurality of frame connectors for connecting the horizontal and arch cross rails to form a frame for a peaked roof, and mounting the frame on the eight vertical posts;

a tarp for covering the frame of the peaked roof;

bungee cords for attaching the tarp to the frame of the peaked roof; and an elongated box having a length, a width and a height, the length being sufficient to house the reduced vertical posts and horizontal cross rails, and the width and the height being sufficient to house the plurality of frame connectors, the tarp, the arch cross rails and the bungee cords.

19. A canopy kit as recited in claim 18, wherein the means for reducing a length thereof is a plurality of first portions removably connectable to a plurality of corresponding second portions.

20. A canopy kit as recited in claim 18, wherein the plurality of frame connectors are nested in a line for reducing a length of the line and covered by at least a portion of the eight vertical posts, the eight horizontal cross rails and the six arch cross rails.

* * * * *

UNITED STATES PATENT AND TRADEMARK OFFICE

CERTIFICATE OF CORRECTION

PATENT NO. : 7,296,584 B2
APPLICATION NO. : 10/793369
DATED : November 20, 2007
INVENTOR(S) : Brian Goldwitz It is certified that error appears in the above-identified patent and that said Letters Patent is hereby corrected as shown below:

Column 4

Line 17, delete "the eight horizontal cross rails and the six arch cross rails." and replace it with --the nine horizontal cross rails and the eight arch cross rails.--

Column 6

Line 53, delete "eight horizontal cross rails" and replace it with --nine horizontal cross rails--
Line 55, delete "six arch cross rails" and replace it with --eight arch cross rails--

Column 8

Line 4, delete "eight horizontal cross rails" and replace it with --nine horizontal cross rails--
Line 5, delete "six arch cross rails" and replace it with --eight arch cross rails--

Signed and Sealed this

Thirtieth Day of November, 2010

David J. Kappos

David J. Kappos
*Director of the United States Patent and Trademark Office*